United States Patent [19]

Puetz et al.

[11] 4,168,417

[45] Sep. 18, 1979

[54] REMOTE OPERATING MECHANISM FOR ELECTRIC SWITCHES

[75] Inventors: Jordan F. Puetz; Wayne J. Schulz, both of Milwaukee, Wis.

[73] Assignee: Square D Company, Milwaukee, Wis.

[21] Appl. No.: 872,394

[22] Filed: Jan. 25, 1978

[51] Int. Cl.[2] ..... H01H 3/20; H01H 3/00; H01H 13/00

[52] U.S. Cl. ..... 200/330; 200/329; 200/335; 200/337; 200/50 A; 200/50 C

[58] Field of Search ..... 200/329, 330, 331, 332, 200/335, 337, 50 A, 50 R, 50 C

[56] References Cited

U.S. PATENT DOCUMENTS

| | | | |
|---|---|---|---|
| 2,904,649 | 9/1959 | Ranson | 200/50 C |
| 3,209,634 | 10/1965 | Daniels | 200/50 C X |
| 3,213,223 | 10/1965 | Sickler | 200/50 C |
| 3,229,056 | 1/1966 | Turnbull | 200/337 X |
| 3,272,953 | 9/1966 | Tillson | 200/330 |
| 3,392,593 | 7/1968 | Paape et al. | 200/329 X |
| 3,475,576 | 10/1969 | Bugni et al. | 200/330 |
| 4,025,742 | 5/1977 | Ranson | 200/50 C X |

*Primary Examiner*—Henry K. Artis
*Attorney, Agent, or Firm*—William H. Schmeling; Richard T. Guttman

[57] ABSTRACT

A mechanism for transmitting movement of an operating handle located at the exterior of an enclosure to an operating handle of a circuit breaker mounted within the enclosure. The mechanism includes components which may be adjusted so the operating handle and circuit breaker may be vertically spaced varying distances from each other and adjustments which will compensate for manufacturing tolerance deviations in the externally mounted operating handle and the circuit breaker which will cause the two operating handles to move concurrently to their two full operating positions.

10 Claims, 5 Drawing Figures

REMOTE OPERATING MECHANISM FOR ELECTRIC SWITCHES

This invention relates to operating mechanisms for circuit interrupting devices and is more particularly concerned with a mechanism which will transmit the movement of an operating handle mounted on the exterior of an enclosure to an operating member of a circuit breaker mounted within the enclosure.

Circuit interrupting devices known as circuit breakers are frequently mounted in enclosures and have their operating members coupled through mechanical linkages to handles that are operated from the exterior of the enclosure so the circuit breaker may be operated to its circuit opening and closing positions without opening the door of the enclosures. Enclosures are frequently manufactured to have standardized dimensions having varying heights and depths. Further, as the enclosures, circuit breakers, operating handles and linkages are furnished by manufacturers to others as individual components and kits for assembly, it is desirable that the kits containing the operating linkage mechanism contain components which may be easily assembled and sized to provide the desired interconnection when the circuit breaker and operating handle are spaced vertically at varying distances from each other. Additionally, certain installation requirements frequently dictate that the circuit breaker be mounted at vertical locations, which would cause the handle to be located at an unsuitable, inconvenient, vertical location. Also, certain installations require that a pair of circuit breakers be simultaneously operated by a single common operation handle and, as manufacturing tolerance variations in circuit breakers cause the operating characteristics in circuit breakers to vary, it is desirable that the operating linkage between the circuit breaker operating member and remotely mounted operation handle contain an arrangement which will cause the operating member to precisely follow the movement of the operating handle as the handle is moved to its two operating positions without damaging the operating member.

It is an object of the present invention to provide a mechanism within an enclosure which will transmit the movement of an operating handle that is movable along the exterior of the enclosure to an operating member of a circuit breaker mounted within the enclosure.

Another object is to provide a mechanism within an enclosure which will transmit the movement of an operating handle that is movable along the exterior of the enclosure to the operating members of a pair of circuit breakers that are mounted within the enclosure.

An additional object is to provide a mechanism within an enclosure with certain components and adjustments so that the operating handle of a circuit breaker mounted within the enclosure will precisely follow the movements of a main operating handle that is movable in a vertical path along the exterior of the enclosure between two operative positions in spite of the fact that the circuit breaker and main handle may be spaced at varying distances vertically from each other and adjustments which will cause the handles to move to either of two operating positions in spite of manufacturing tolerance deviations which may be present in the circuit breaker.

A further object is to provide a mechanism within an enclosure with certain components and adjustments which will cause the operating handles on a pair of circuit breakers that are vertically spaced and mounted within the enclosure to precisely follow the movement of a main operating handle that is movable in a vertical path along the exterior of the enclosure between two operative positions in spite of the fact the operating handles of the circuit breaker and main handle have different operating characteristics because of manufacturing tolerance deviations.

Further objects and features of the invention will be readily apparent to those skilled in the art from the following specification and from the appended drawings illustrating certain preferred embodiments, in which.

Figure 1:
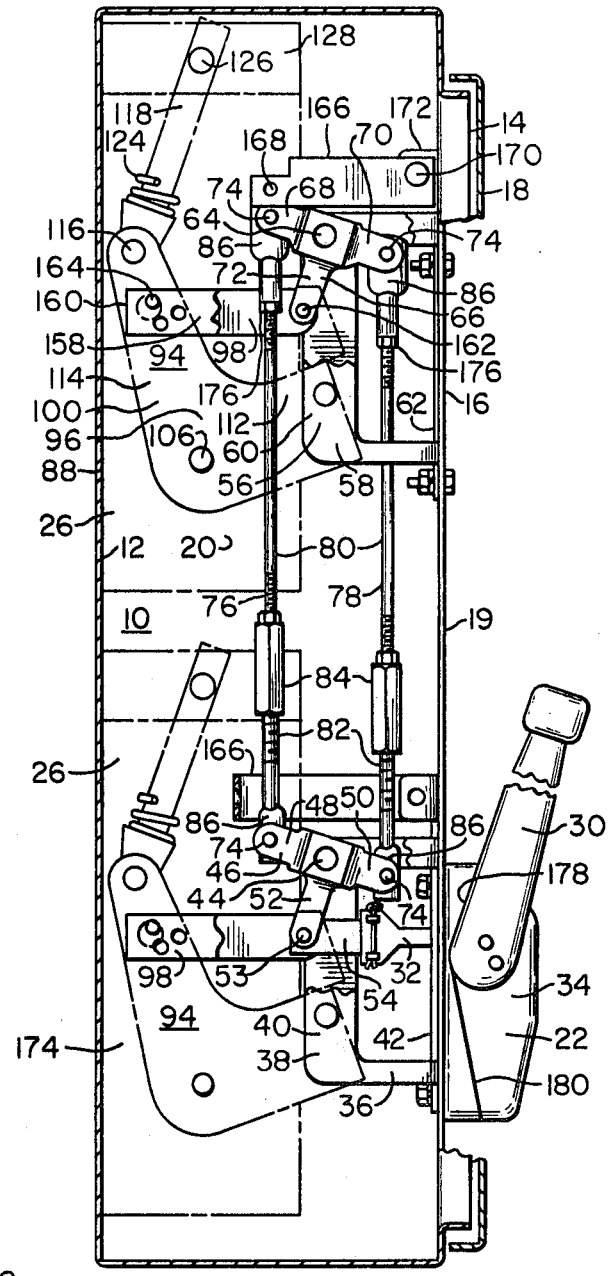
FIG. 1 is a side cross-sectional view of an enclosure having a pair of vertically spaced circuit breakers mounted therein and a mechanism according to the present invention for operating the operating handles of the circuit breakers in response to the movement of an operating handle that is movable along the external front of the enclosure.
Figure 2:
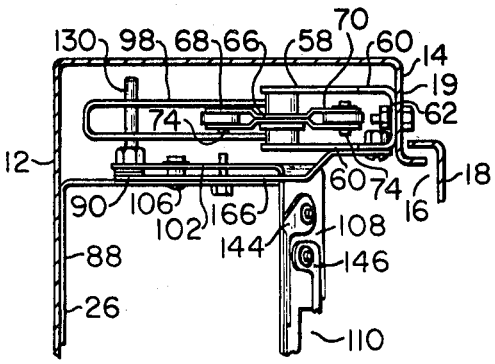
FIG. 2 is a top view of a portion of the enclosure and mechanism in FIG. 1 with the circuit breaker removed.
Figure 4:
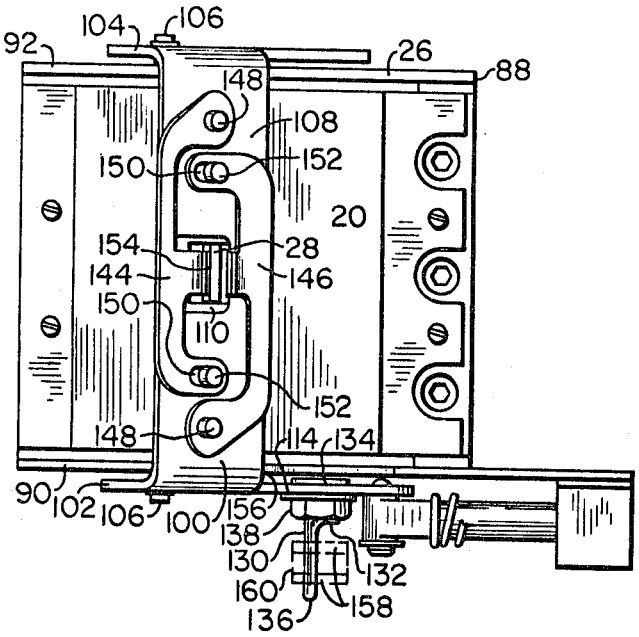
FIG. 4 is a front view of a circuit breaker and a mechanism for transmitting motion to the operating handle of the circuit breaker as shown in FIG. 1.
Figure 5:
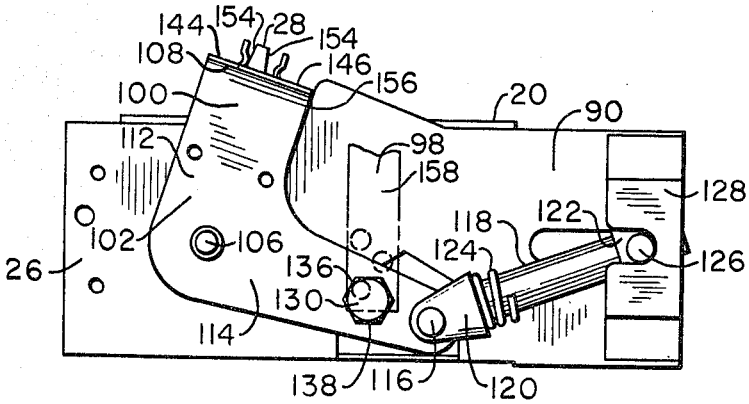
FIG. 5 is a side view of the circuit breaker and mechanism as shown in FIG. 4.

As shown in the drawings, an enclosure or housing 10 has a rear wall 12 which may be mounted to a suitable wall or support, not shown, and a front side 14 having an opening 16 therein. The opening 16 is closable by a door 18. In the embodiment shown, the enclosure 10 is of the type disclosed in U.S. Pat. No. 3,229,056 which was granted to Merlin Y. Turnbull on Jan. 11, 1966. As fully disclosed in the Turnbull patent, the opening 16 and the door 18 are sized so that when the door 18 is closing the opening 16, a flange 19 on the housing 10 that extends along the side of the door will be exposed. A handle operating mechanism 22 is mounted on the flange 19 on the front side of the housing 10. As shown in FIG. 1, a circuit interrupting device, in the form of a circuit breaker 20, is mounted by means of a support 26 on the rear wall 12 so the front side of the circuit breaker 20 is located a predetermined distance to the rear of the front side 14. The circuit breaker 20 is a well known commercially available device and, as shown in FIGS. 4 and 5, includes an operating member 28 which is movable in an arcuate vertical path between two operating positions to open and close a circuit in which the circuit breaker 20 is connected. The handle mechanism 22 is mounted on the flange portion 19 in a position where it is vertically displaced from the circuit breaker 20. The handle mechanism 22 is most clearly shown in the Turnbull patent, supra, and includes an operating handle 30 which is movable in an arcuate vertical path along the exterior of the housing 10 between two operating positions. The handle mechanism 22 also includes a link 32 that extends through an opening in the flange 19 and is moved by a means, not shown, within a housing portion 34 of the mechanism 22 along a horizontal path between two positions as the operating handle 30 is moved along its vertical path between its two positions.

An operating lever mechanism 36 is mounted on the rear side of the flange 19 in horizontal alignment with the handle mechanism 22. The mechanism 36 includes a support member 38 that is formed as a U-shaped channel member to have a pair of spaced arms 40 extending parallel to each other from a bight portion 42. Bight portion 42 is secured to the rear side of the flange 19 by suitable bolts which also secure the handle mechanism 22 to the front side of the flange. When the support member 38 is thus secured, the arms 40 extend perpendicular to the flange 19 into the interior of the housing 10. Extending between the arms 40 is a pivot pin 44 on which an operating lever 46 is rotatably mounted. The operating lever 46 includes a pair of arms 48 and 50 that extend in opposite directions from the pin 44 and a third arm 52 which extends from the pin 44 downwardly and preferably perpendicular to the arms 48 and 50. The mechanism 36 additionally includes a drive link 54 that is connected through a pivot pin 53 to a free end on the arm 52 and through the link 32 to provide a connection whereby the operating lever 46 is connected to the operating handle 30 so the operating lever 46 is moved in response to the movement of the operating handle 30 when the handle is moved to its two operating positions.

An operated lever mechanism 56 is mounted on the rear side of the flange 19 in horizontal alignment with the circuit breaker 20. The mechanism 56 includes a support member 58 that is substantially identical with the support member 38 and is formed as a U-shaped channel member to have a pair of spaced arms 60 extending parallel to each other from the bight portion 62. The bight portion 62 is secured to the rear side of the flange 19 by suitable bolts in vertical alignment with the support member 38. When the support member 58 is thus secured, the arms 60 extend perpendicular to the flange in parallel relation with the arms 40 into the interior of the housing 10. Extending between the arms 60 is a pivot pin 64 on which an operated lever 66 is rotatably mounted. The operated lever 66 includes a pair of arms 68 and 70 that extend in opposite directions from the pivot pin 64 and a third arm 72 which extends from the pin 64 downwardly and preferably perpendicular to the arms 68 and 70. The support member 38, the pin 44, and the operating lever 46 have the same shape and dimensions as the support member 58, the pivot pin 64, and the operated lever 66, respectively. Located at the free ends of each of the arms 48, 50, 68 and 70 are connecting pins 74. The connecting pins are located on their associated arms equidistant from the pivot pins 44 and 64.

Figure 3:
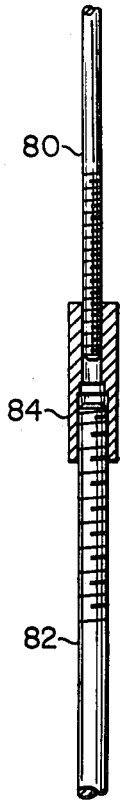
FIG. 3 is a view partly in cross-section of a portion of an operating rod assembly as used in the mechanism in FIG. 1.

A pair of operating rod assemblies 76 and 78 are provided as a means for transmitting the movement of the operating lever 46 to the operated lever 66 as the handle 30 is moved between its two positions. The operated rod assemblies 76 and 78 are identical and each includes a pair of rods 80 and 82 which are interconnected by a coupling 84. The rods 80 are smaller in diameter than the rods 82 and have threads on one end which are dissimilar in pitch to the threads on one of the ends of the rods 82. As shown in FIG. 3, the coupling 84 has a bore extending therethrough and threaded coaxial lined openings extending from the opposite ends thereof which threadedly receive the threaded ends of the rods 80 and 82. Positioned on each of the ends of the rods 80 and 82 remote from the couplings 84 is a clevis 86. The clevis portions 86 on the rod assembly 76 are connected through pins 74 to the arms 48 and 68, respectively. Similarly, the clevis portions 86 on the rod assembly 78 are connected through pins 74 to the arms 50 and 70.

As shown in FIGS. 1, 2, 4 and 5, the support 26 is formed as a U-shaped channel member having a bight portion 88 on which the rear side of the circuit breaker 20 is mounted. Extending forwardly from opposite sides of the bight portion along opposite sides of the circuit breaker 20 are flange-like walls 90 and 92. A mechanism 94 for transmitting movement of the operated lever 66 to the operating member 28 includes a lever assembly 96 and a link 98.

The lever assembly 96 includes a U-shaped member 100 that has a pair of arms 102 and 104 extending along opposite sides of the circuit breaker 20. The arms 102 and 104 are pivotally mounted on the walls 90 and 92 respectively by pivot pins 106. A bight portion 108 on the U-shaped member 100 extends across the front side of the breaker 20 and interconnects the arms 102 and 104 at the front side of the breaker 20. The bight portion 108 has an opening 110 centrally located therein through which the operating member 28 extends with clearance.

The arm portion 102 has a bell-crank shape and includes a lever portion 112 that extends from the pivot pin 106 to the bight portion 108 and a lever portion 114 that extends from the pivot pin 106 to a free end whereon a pivot pin 116 is secured. A toggle mechanism 118 includes a toggle part 120 and a toggle part 122 which are telescopically connected and are constantly urged out of their respective telescopic connection by a toggle spring 124. The toggle part 120 has a bore which rotatably receives the pin 116. The toggle part 122 has pin portions 126 which are received in suitable slots in a support 128 that is secured to the flange-like wall portion 90.

An adjustable pivot pin 130 is secured to the lever portion 114 at a location intermediate the pivot pin 106 and the pivot pin 116. Adjustable pivot pin 130 includes a threaded mounting portion 132 that is rotatably received in an opening in the lever portion 114 and extends to a headed portion 134 that engages surface portions of the lever portion 114 that surrounds the opening through which the threaded mounting portion 132 extends. The headed portion 134 is movable in the space between the lever portion 114 and the wall 90. Extending outwardly from the mounting portion 132 from the end remote from the headed portion 134 is a pivot pin portion 136. The pivot pin portion 136 extends eccentrically outwardly from the axis of the mounting portion 132 so that as the mounting portion 132 is rotated in the opening in lever 114 the distance between the pivot pin portion 136 and the pivot pin 106 may be adjustably varied. The adjusted position of the pivot pin portion 130 is maintained by a securing nut 138 which is threaded on the mounting portion 132 into tight engagement with the lever portion 114.

A pair of members 144 and 146 are secured on the front surface of the bight portion 108 on opposite sides of the operating member 28. The members 144 and 146 are identical and each includes an opening in one outer leg which receives a pivot screw 148 that is threaded into the bight portion 108. The other outer leg of the members 144 and 146 is provided with an elongated slot 150 that receives a securing screw 152. The central leg of each of the members 144 and 146 includes a flange portion at its outer end which provides a surface 154 that is moved into engagement with the operating member 28 to move the operating member into its full ON and OFF positions. In the drawings, the circuit breaker is shown in the ON position with the lever portion 112 engaging a stop surface 156 that is formed on the front edge of wall 90. The position of the members 144 and 146 on the bight portion 108 is adjusted as follows. Initially, screws 148 and 152 are loosened. When the circuit breaker is in the ON position as shown, the member 144 is moved to a position where its associated surface 154 engages the surface on the operating member 28 and the screws 148 and 152 associated with the member 144 are tightened. The member 146 is then adjusted to provide a slight clearance between its associated surface and the member 28 and the screws 148 and 152 associated with the member 146 are tightened. The slight clearance that is provided for the space between the surface 154 on member 146 and the top surface on member 28 assures that the toggle mechanism within the circuit breaker 20 will cause the operating member 28 and the associated parts within the breaker 24 to be in full ON position.

The link 98 is formed by a pair of spaced parallel arms 158 that extend from a bight portion 160. Arms 158 have suitable openings on one end to receive a pin 162 which provides a connection with the arm 72. Similarly, the end of the arms 158 adjacent the bight portion 160 are provided with openings which receive the pivot pin portion 136 to provide a connection between the arm 72 and the lever portion 114. As shown in the drawing, the plurality of openings 164 spaced at varying distances from the pin 162 are included in the arms 158 so that the mechanism may be used with circuit breakers of different types.

If required, a strut 166 may be provided to resist movement of the support 26 when the circuit breaker 20 is operated in response to the movement of the handle 30. In the embodiment shown, the strut 166 is formed as an elongated metal part having an opening at one end which is used by means of a screw 168 to secure one end of the strut 166 to the top front portion of the wall 90. The other end of the strut has an opening therein which receives a screw 170 and secures the strut to a flange 172 extending from the bight portion 42.

As shown in FIG. 1, a second circuit breaker 174 may be mounted in the lower portion of the housing in horizontal alignment with the operating lever mechanism 36 and the handle mechanism 22 to be operated simultaneously with the circuit breaker 20 at the upper portion of the housing 20 in response to the movement of the handle 30. In the preferred embodiment, the second circuit breaker, its associated mechanism and link are identical to the circuit breaker 20, the mechanism 94 and the link 98, as previously described, so that further description of the second circuit breaker 174 and its associated motion transmitting mechanism is not believed required. However, when the second circuit breaker is mounted on the rear wall 12 it is mounted to be horizontally aligned with the handle mechanism 22 and its associated link 98 is connected by means of the pin 53 to the arm 52 on the operating lever mechanism 36 in the same manner that the link 98 is connected to the third arm 72 by means of the pin 162.

The assembly and the adjustments of the components heretofore described and shown in FIG. 1 is as follows. The handle mechanism 22, the operating lever mechanism 36, the operated lever mechanism 56, the circuit breakers 20 and 174, together with their associated mechanisms 94 and link 98 are mounted within the enclosure 10. If required, the struts 166 are mounted as heretofore described to resist movement of the circuit breaker and its associated parts in response to the movement of the handle 30. The links 98 associated with the circuit breakers 20 and 174 are secured by pins 162 and 53, respectively.

Initially the circuit breakers 20 and 174 together with their associated mechanisms 94, the handle mechanism 22, the operating lever mechanism 36, the operated lever mechanism 56, and the struts 166 associated with breakers 20 and 174 are mounted within the enclosure as described. The links 98 associated with breakers 20 and 174 are then connected between pivot pin portions 136 and pins 162 and 53, respectively.

The rod assemblies 76 and 78 have identical overall lengths and preferably the lengths of rods 80 of assemblies 76 and 78 are identical and the length of the rods 82 of the assemblies 76 and 78 are identical. The rods 80 and 82 have precut lengths to provide a predetermined space between the threaded ends of the rods 80 and 82 when the rods are connected to their associated couplings 84, clevises 86 and pins 74 to the arms on operating levers 46 and 66. The space between the threaded ends of the rods 80 and 82 is shown in FIG. 3 and, in the preferred embodiment, is approximately $\frac{1}{4}$ inch. As shown in FIG. 1, the clevises 86 are integrally formed on one end of the rods 82 and the clevises 86 associated with rods 78 are formed as separate elements having threaded bores which receive threaded ends on the rods 80 remote from the coupling 84. The assembly of the rods 80 and 82 is accomplished as follows. Initially the rods 82 are connected through their associated clevis portions 86 and pins 74 to the arms 48 and 50. The clevises 86 associated with the rods 80 are connected through their associated pins 74 to the arms 68 and 70. A securing nut 176 is then threaded on the threads on each of the rods 80 and the rods 80 are fully threaded into their associated clevises 86. After the rods 80 are threaded into their associated clevises 86, the securing nuts 176 are tightened against the clevises 86 to prevent the rods 80 from rotating. As shown in FIG. 3, the rod 80 has a smaller diameter than rod 82. After the foregoing assembly of the rods 80 and 82 on the arms 48 and 58 and the arms 50 and 70 has been completed, the couplings 84 are then threaded on the thread ends of the rods 80 to a position where the free ends of the rods 80 are flush with the end of the coupling which receives the rod 82. The couplings 84 are then unthreaded from the rods 80 and threaded onto the rods 82. As previously indicated, the threads on rods 80 and 82 have different pitch with the pitch on the rods 80 being less than the pitch on the rods 82. Thus as the couplings 84 are threaded onto the rods 82, the couplings 84 will advance at a faster rate on the rods 82 than they retreat on the threads on the rods 82 and thus draw the rods 80 and 82 toward each other and thus cause the rods to be in tension and provide a ridged connection between the levers 36 and 46.

Initially the handle 30 is moved to its first operating position, known as the ON position, where the handle engages a stop surface 178 on the housing 34. The position of the handle 30 against the stop surface 178 is maintained by the toggle mechanisms 118 associated with the breakers 20 and 174. The rotation of the handle 30 to its ON position will cause the arms 102 on the mechanisms 94 associated with breakers 20 and 174 to be positioned against their associated stop surfaces 156 so that the position of the members 144 and 146 may be adjusted, as previously described, relative to the operating members 28 of the breakers 20 and 174.

Circuit breakers conventionally are provided with suitable mechanisms which will cause the operating handle and the contacts of the breaker to move to a tripped position and open the contacts of the breaker when an excess current flows through the breaker. Additionally, certain well known types of the breakers include an arrangement where the circuit breaker may be manually tripped to test the breaker. Also, conventionally, tripped circuit breakers are provided with an arrangement which will cause the breaker to be reset so that the contacts will move to the full ON position and full OFF positions in response to the movement of its operating handles. Resetting of the breaker usually occurs when the operating handle of the breaker is moved from the ON position through an OFF position to a RESET position. Thus, after members 144 and 146 have been adjusted as described, the handle 30 is moved vertically downwardly toward its second operating position, known as the OFF-RESET position, to a position where the handle 30 engages a stop surface 180 on the housing 134. The toggle mechanisms 118 associated with the breakers 20 and 174 are arranged to urge the handle 30 to its full OFF position where it engages the stop 180. In the event that the handle 30 does not engage the stop surface 180, the adjustable pivot pins 130 associated with the breakers 20 and 174 are then adjusted by roating the threaded mounting portion and thereby repositioning the pivot pin portion so that the handle 30 will be maintained in its proper OFF-RESET position where it engages the stop surface 180. After the foregoing adjustments have been made, the handle is returned to its ON position and the components within the breaker are caused to move to their trip position by either using a mechanical arrangement provided in the breaker or causing the breaker to trip in response to an excess current flow therethrough. The handle 30 is then moved from the ON position to its OFF-RESET position where the handle 30 engages a stop 180. The movement of the handle 30 to the OFF-RESET position should cause the components of the breakers 20 and 174 to reset. In the event that the breakers do not reset when the handle 30 is moved to the OFF-RESET position, the position of the member 146 on the bight portion 108 of the mechanism associated with the breaker that fails to reset is adjusted as previously described to decrease the space between surface 154 and the operating member 28 and the procedure for checking if the breakers are reset when the handle is moved to the OFF-RESET position is repeated.

While certain preferred embodiments of the invention have been specifically disclosed, it is understood that the invention is not limited thereto, as many variations will be readily apparent to those skilled in the art and the invention is to be given its broadest possible interpretation within the terms of the following claims.

What is claimed is:

1. In combination, a housing having a door movable to close an opening in a front side of the housing, a circuit interrupting device mounted in the housing on a rear wall of the housing, said device having an operating member movable in an arcuate vertical path between two operating positions to open and close the circuit interrupting device, and an operating mechanism for moving the operating member to its two operating positions from a location remote from the circuit interrupting device, said operating mechanism comprising: an operating handle mechansim mounted on the front side of the housing at a location vertically displaced from the circuit interrupting device, said operating handle mechanism including an operating handle movable in an arcuate vertical path along the exterior of the housing between two operating positions, an operating lever rotatably mounted within the housing on a pivot, said operating lever including a pair of arms extending in opposite directions from the pivot and a third arm extending from the pivot at an angle to the pair of arms, and means connecting the operating handle and third arm for rotating the operating lever between two operating positions in response to the movement of the operating handle to its two operating positions, an operated mechanism mounted within the housing at the front side of the housing in substantial horizontal alignment with the circuit interrupting device, said operated mechanism including: an operated lever rotatably mounted within the housing on a pivot, said lever including a pair of arms extending in opposite directions from the pivot and a third arm extending from the pivot at an angle to the pair of arms, a first means for transmitting the movement of the operating lever to the operated lever, said first means including: a first operating rod assembly connecting a first of said pair of arms on the operating lever to a first of said pair of arms on the operated lever, a second operating rod assembly connecting a second of said pair of arms on the operating lever to a second of said pair of arms on the operated lever, each of said rod assemblies including a pair of rods having threads at one end with the pitch of the threads on one of said rods dissimilar to the pitch on the threads on the other of said rods, and a coupling having threaded coaxially aligned openings extending from opposite ends thereof threadedly receiving the threaded ends of the pair of rods and a second means for transmitting the movement of the operated lever to the operated member, said second means including: a U-shaped member having a pair of movable arms pivotally mounted on opposite sides of the circuit interrupting device, a bight portion interconnecting the pair of arms at the front side of the device, said bight portion having an opening therein receiving the operating member with clearance, and a pin extending eccentrically from a mounting outwardly from and intermediate the ends of one of the pair of arms of the U-shaped member, a connecting lever having a first end pivotally mounted on a free end of the third arm on the operated lever and an opening on a second end receiving the pin for transmitting the movement of the operated lever to the U-shaped member and thereby the movement of the operating handle to the U-shaped member as the operating handle is moved to its two operating positions, and a pair of members adjustably secured on said bight portion with a first of said members having a portion engaging the operating member when the operating member and operating handle are at their respective first of the two operating positions and a second of said members having a portion spaced a predetermined distance from the operating member when the operating handle and operating member are at the respective second operating positions.

2. The combination as recited in claim 1 including a second interrupting device mounted in the housing on a rear wall of the housing in substantial horizontal alignment with the operating handle mechanism, said second device having an operating member movable in an arcuate vertical path between two operating positions to open and close the second device and a third means for moving the operating member of the second device to its two operating positions in response to the movement of the operating handle to its two operating positions said third means including: a U-shaped member having a pair of movable arms extending rearwardly along opposite sides of the second device, a bight portion interconnecting the arms of the U-shaped member at the front side of the second device, said bight portion having an opening therein receiving the operating member of the second device with clearance, a fourth means for transmitting the movement of the operated lever to the operating member of the second device, said fourth means including a motion transmitting assembly interconnecting the third arm on the operating lever with one of the arms on the second mentioned U-shaped member, and a pair of members secured on the second mentioned bight portion with a first of said members having a portion engaging the operating member of the second device when the operating member of the second device and the operating handle are at their respective first of their two operating positions and a second of said pair of members having a portion spaced a predetermined distance from the operating member on the second device when the operating member on the second device and operating handle are at their respective second operating positions.

3. The combination as recited in claim 1 wherein said second means includes a toggle mechanism that is pivoted on one of the pair of arms of the U-shaped member for releasably maintaining the U-shaped member and operating handle at their respective two operating positions.

4. The combination as recited in claim 2 wherein the second and the third means each includes a toggle mechanism for releasably maintaining the U-shaped members of the second and the third means and the operating handle at their respective two operating positions.

5. The combination as recited in claim 1 wherein the pin includes a mounting portion extending through an opening in the said one arm of the U-shaped member, a means for securing the mounting portion in an adjusted rotated position in the opening and a pin extending eccentrically from the mounting portion for adjusting the effective operating length of the connecting lever.

6. The combination as recited in claim 2 wherein the motion transmitting assembly includes a member pivotally mounted on the free end of the third arm of the operating lever and threaded rod having an end pivotally connected to the said one arm of the second mentioned U-shaped member and an end adjustably positioned on a free end of the motion transmitting member.

7. The combination as recited in claim 2 wherein the pin includes a mounting portion extending through an opening in the said one arm of the U-shaped member, a means for securing the mounting portion in an adjusted rotated position in the opening and a pin extending eccentrically from the mounting portion for adjusting the effective operating length of the connecting lever.

8. The combination recited in claim 7 wherein the motion transmitting assembly includes a member pivotally mounted on the free end of the third arm of the operating lever and threaded rod having an end pivotally connected to the said one arm of the second mentioned U-shaped member and an end adjustably positioned on a free end of the motion transmitting member.

9. The combination as recited in claim 1 wherein each of the pair of members that are secured on the bight portion is substantially E-shaped with one of the outer legs of the E-shaped member pivotally mounted on the bight portion and another outer leg of the E-shaped member is adjustably secured to the bight portion in a position where a central leg of one E-shaped member engages the operating member when the operating member is at one of its two operating positions.

10. The combination as recited in claim 2 wherein each of the pair of members that are secured on the bight portion is substantially E-shaped with one of the outer legs of the E-shaped member pivotally mounted on the bight portion and another outer leg of the E-shaped member is adjustably secured to the bight portion in a position where a central leg of one E-shaped member engages the operating member when the operating member is at one of its two operating positions.

* * * * *